US005849097A

United States Patent [19]

Windmeisser

[11] Patent Number: 5,849,097

[45] Date of Patent: Dec. 15, 1998

[54] APPARATUS FOR PROCESSING A BASE WITH A ROTATING MEMBER

[75] Inventor: Dieter Windmeisser, Munchwilen, Switzerland

[73] Assignee: Diversey Lever, Inc., Plymouth, Mich.

[21] Appl. No.: 790,880

[22] Filed: Feb. 3, 1997

[30] Foreign Application Priority Data

Feb. 9, 1996 [EP] European Pat. Off. ..... 96200289

[51] Int. Cl.[6] ..... B08B 1/04; A47L 11/162; A47L 11/283

[52] U.S. Cl. ..... 134/6; 15/49.1; 15/50.1; 15/79.2; 15/98

[58] Field of Search ..... 15/49.1, 50.1, 15/79.2, 98; 134/6

[56] References Cited

U.S. PATENT DOCUMENTS 3,299,460 1/1967 Burgoon ..... 15/49.1
4,910,824 3/1990 Nagayama ..... 15/49.1
5,615,437 4/1997 Takahashi ..... 15/49.1

FOREIGN PATENT DOCUMENTS 073 725 3/1983 European Pat. Off. .
640 314 3/1995 European Pat. Off. .
6154141 6/1994 Japan ..... 15/49.1

*Primary Examiner*—Randall E. Chin
*Attorney, Agent, or Firm*—A. Kate Huffman

[57] ABSTRACT

An apparatus for processing a base such as brushing or rubbing a floor, with the aid of a rotating member, is described. The apparatus contains a frame or chassis, a coupling means which couples to the rotating member, a means for driving the rotating member and a means for varying the magnitude and position of the pressing force of the rotating member relative to the base.

8 Claims, 2 Drawing Sheets

APPARATUS FOR PROCESSING A BASE WITH A ROTATING MEMBER

BACKGROUND OF THE INVENTION

For scrubbing and polishing relatively large floor areas, frequent use is made of apparatus having a rotating member provided with a scrubbing or polishing material. Such apparatus exerts a biased angular momentum to one side on the floor or surface, whereby the apparatus tends to deflect sideways from the desired path in a straight ahead direction, because of the reaction forces exerted by the surface on the apparatus.

To prevent this, it is possible to dispose the rotating member at a relatively small angle, whereby a forward force to such apparatus is also yielded. This is particularly advantageous if the apparatus is equipped with non-driven wheels whereby the scrubbing machine has to be pushed by human power. It is also known to cardianically suspend the rotating member and to exert pressure locally on the rotating member.

The known techniques show a disadvantage, as the operation of the rotating member, e.g. for cleaning purposes, will vary, dependent on the roughness/smoothness of the floor. The above solutions are therefore a compromise, especially if the apparatus has to be suited for any scrubbing element as well as for any polishing cloth having a different friction coefficient relative to various surfaces or floors.

SUMMARY OF THE INVENTION

The present invention provides an apparatus for processing a surface (such as a floor), having

- a rotating member having processing and/or cleaning means associated therewith, said rotating member for exerting force on the surface, such as brushing or rubbing a floor;
- a chassis;
- coupling means arranged on the chassis for coupling the rotating member to the chassis;
- driving means arranged in the chassis for driving the rotating member: and
- varying means for varying the magnitude and/or position of the pressing force of the rotating member relative to the surface.

DESCRIPTION OF PREFERRED EMBODIMENTS

The apparatus according to the present invention can be adapted by the varying means to take into account the extent of the roughness of the surface and the extent of roughness of the scrubber or polishing element. The user can, as he/she wishes, bias the desired forward force and reduce or increase the angular momentum exerted by the rotating means.

The driving means may use fluid or gaseous medium. In the preferred embodiment, however, the driving means comprise an electric motor and more preferably the apparatus is provided with a rechargeable battery so that wires can be dispensed with while the apparatus is in operation.

As discussed above the apparatus preferably comprises two non driven rear wheels. The present invention, however, is also advantageous for an apparatus with driven rear wheels, to prevent additional load on the bearings and/or gearing of one or more of the rear wheels.

In a further preferred embodiment the apparatus is provided with a central driven wheel, for reducing the pushing forces.

Further advantages, features and details of the present invention will be clarified by means of the following description of preferred embodiments thereof, with reference to the drawings.

Figure 1:
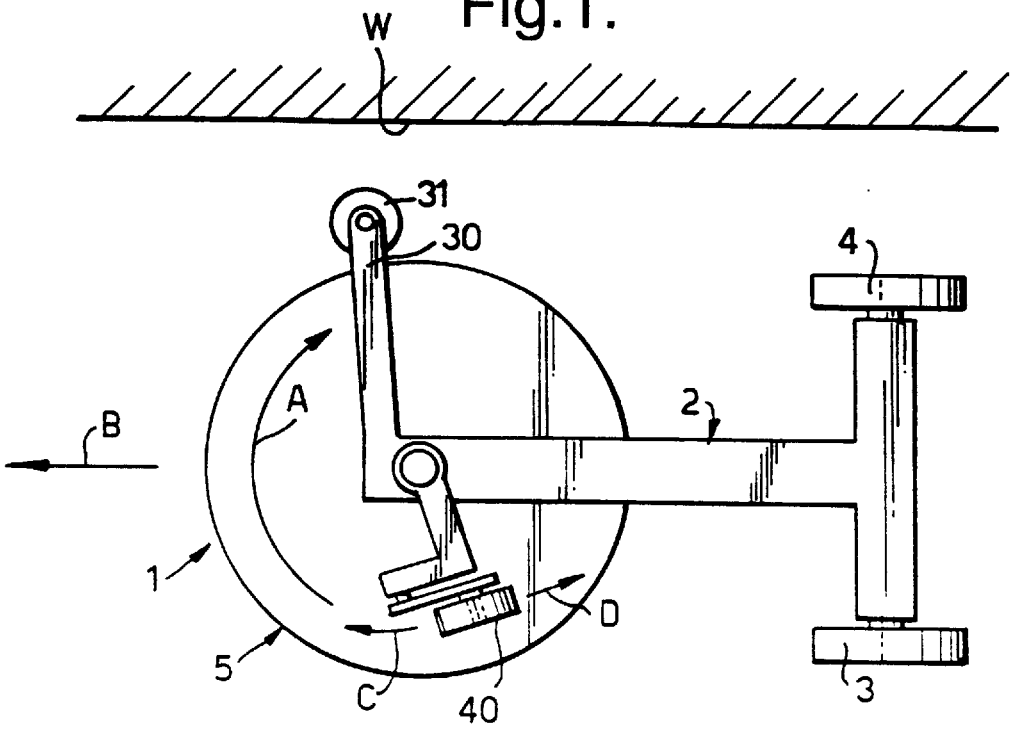
FIG. 1 shows a principal diagram of an apparatus according to the present invention.

An apparatus 1 (FIG. 1) comprises a chassis 2, from which two non-driven rear wheels 3, 4 are mounted. A substantially horizontal wheel or disk 5 depending under the chassis 2 is driven in the direction of arrow A. To prevent the disk or wheel 5 damaging a wall W, the apparatus is preferably provided with a chassis part 30 projecting beyond the circumference of the disk on which a freely rotatable, protective wheel 31 is disposed.

The wheel or disk 5 exerts angular momentum relative to the pair of rear wheels in the direction of arrow A relative to the surface, whereby the surface exerts angular momentum in the opposite direction to the apparatus, which results in a tendency of the apparatus to deflect to one side. This can therefor be undesirable especially in the present embodiment where the rear wheels 3, 4 are not driven. To prevent this undesirable momentum, a pressing member 40 is arranged on chassis 2, which obviates or reduces angular momentum and converts this into a force in the forward direction, Arrow B, which force also facilitates pushing the apparatus. As the pressing member 40 is displaceable in the direction of the arrows C and D, the direction of the pressing force is adjustable relative to the disk, whereby the magnitude of the reaction angular momentum exerted by the surface on the apparatus and the magnitude of the propelling force are also adjustable. In use on a rough surface or floor for example the pressing member is displaced in the direction of arrow D, while the forward force is decreased, while the listing to the side of the apparatus is reduced to a sufficient extent. When adjusted in the direction of arrow C, the forward force increases and the angular momentum exerted by the surface on the apparatus decreases.

The wheel 5, in this embodiment is formed by a spoked wheel and a closed diskshaped plate, and is driven by a first belt or string 12 extending around pulleys 10 and 11 and a further belt extending around pulleys 8 and 9, the pulleys 9 being driven by an electric motor 7. Pulley 11 is disposed under a pivotable support part 13. A tension spring 14 maintains the tension in belt 12. Preferably the apparatus is provided with a prechargeable battery, so that an electric cable can be dispensed with during the operation.

Wheel 5 and disk 6 are attached to the chassis by means of a cardanic suspension 15 which is disposed on a suspension frame part 16, whereby wheel 5 and disk 6 are movable in substantially all directions, and at least in the pivot direction imposed by pressing member 40.

Pressing wheel 20 is pivotably disposed on a suspension part 22 via arm 21, which suspension part 22 is secured to the cardanic suspension 15. The pressing force of the pressing wheel 20 can be varied by screwing of a counter weight 23 which is provided on a further arm 24 to a pivot axis 25. Pressing wheel 20 is in the present embodiment, formed by a wear-resistant wheel of plastic material.

The position of the pressing wheel 20 is adjustable along the circle arc of arrows C and D by means of an adjusting knob 26 which can be arrested e.g. in a depressed rest position, and which will displace a toothed rack 28, according to the circle arc through toothed pinion 27, when it is lifted and turned.

In practice the user will primarily adjust the position of the pressing wheel of the disk dependent on the roughness/ ,smoothness of the surface to be scrubbed or polished and dependent on the type of scrub element of polishing element present under the disc, as this biasing can be executed easily form the exterior. Biasing the pressing force will have to be done in the interior of the apparatus e.g. by screwing and displacing of the counter weight.

In a non shown way, the apparatus is preferably provided with a central driven wheel for driving the apparatus.

It goes without saying that the present invention is not limited to the above describe preferred embodiment thereof. The requested rights are primarily defined by the following claims, within the scope of which carious modifications are possible.

Figure 3:
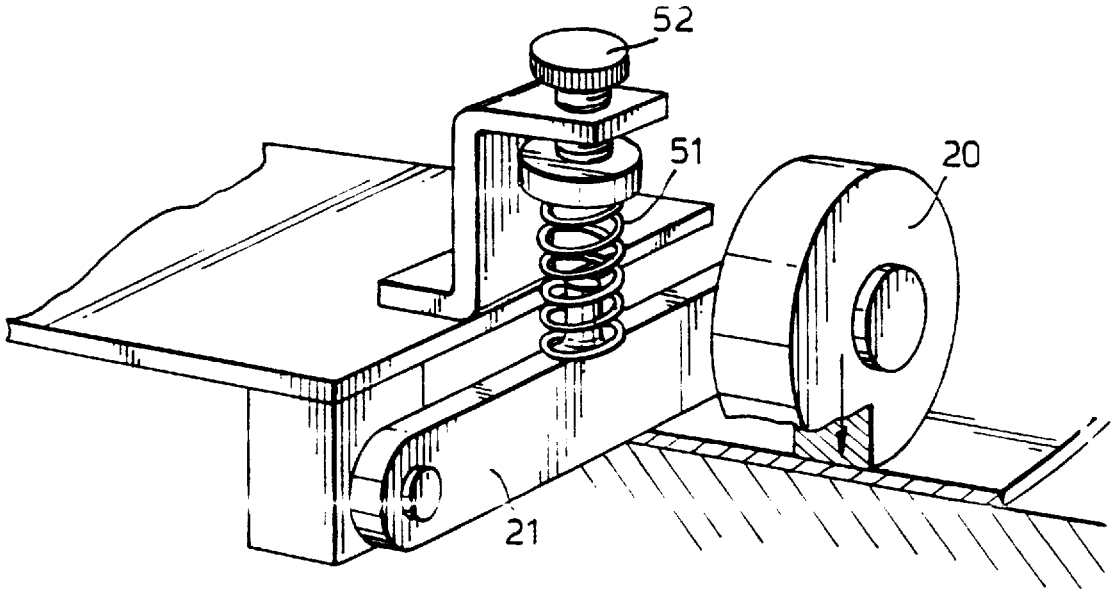
FIG. 3 shows a perspective view of an alternative part of the embodiment of FIG. 2.
Figure 2:
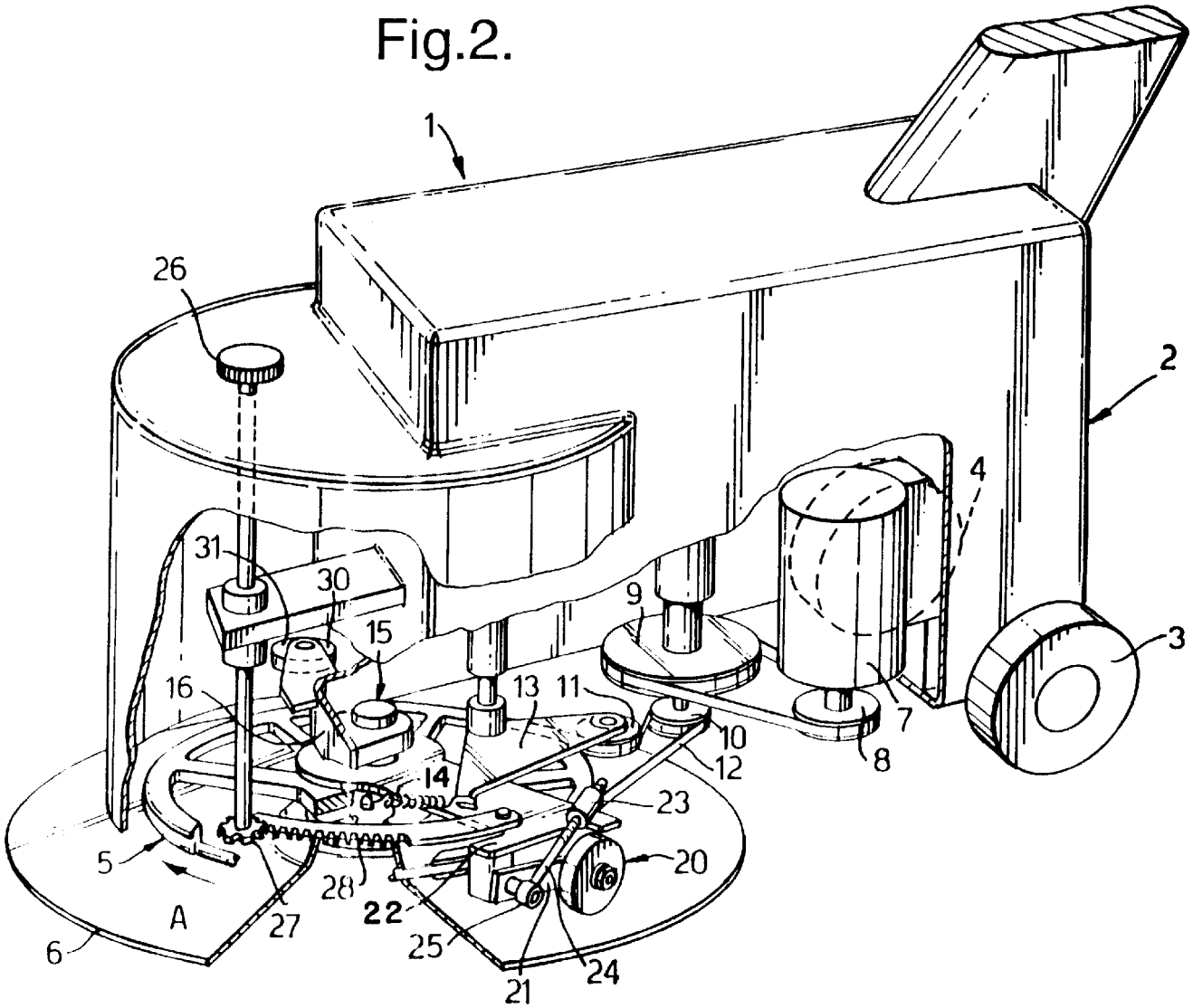
FIG. 2 shows a perspective partly broken away view of the embodiment of FIG. 1.

A variation which is not limited, relates e.g. to the way in which the force exerted by the pressing wheel to the disc is adjusted. As shown in FIG. 3, this force can also be adjusted by a screw spring 51 which can be adjusted by turning knob 52.

I claim:

1. An apparatus for processing a surface comprising:

(a) a chassis;

(b) a rotating member associated with the chassis and used for exerting a pressing force on the surface;

(c) coupling means arranged in the chassis for coupling the rotating member to the chassis;

(d) driving means arranged in the chassis for driving the rotating member, the driving means comprising at least one driving wheel for driving the rotating member through a belt; and (e) varying means for varying a magnitude of the pressing force of the rotating member relative to the surface, the varying means comprising a pressing wheel having a pressing force which is varied by adjusting means comprising an adjustable counter weight, the varying means having a position relative to the rotating member which is varied by the adjusting means, the adjusting means comprising a toothed rack and pinion.

2. An apparatus according to claim 1, further comprising at least two non-driven rear wheels.

3. An apparatus according to claim 1, wherein the coupling means comprise cardanic suspension means.

4. An apparatus according to claim 1, in which the driving means comprise an electric motor and at least transmission belt for transmitting driving force of the electric motor to the rotating member.

5. An apparatus according to claim 4, provided with a chargeable battery for supplying power to the motor.

6. An apparatus according to claim 1, provided with a frame part projecting beyond the rotating member and to which a free running wheel is secured.

7. An apparatus according to claim 1 wherein the pressing force of the rotating member is a brushing force.

8. A method for processing a floor area comprising the steps of:

brushing or rubbing a floor area with an apparatus comprising:

(a) a chassis;

(b) a rotating member associated with the chassis and used for exerting a pressing force on the surface;

(c) coupling means arranged in the chassis for coupling the rotating member to the chassis;

(d) driving means arranged in the chassis for driving the rotating member, the driving means comprising at least one driving wheel for driving the rotating member through a belt; and (e) varying means for varying a magnitude of the pressing force of the rotating member relative to the surface, the varying means comprising a pressing wheel having a pressing force which is varied by adjusting means comprising an adjustable counter weight, the varying means having a position relative to the rotating member which is varied by the adjusting means, the adjusting means comprising a toothed rack and pinion.

* * * * *